US007434890B2

(12) United States Patent
Yao et al.

(10) Patent No.: US 7,434,890 B2
(45) Date of Patent: Oct. 14, 2008

(54) VIBRATORY MILLING MACHINE HAVING LINEAR RECIPROCATING MOTION

(75) Inventors: Jing James Yao, Mississauga (CA); Robert Eugene Able, Bozeman, MT (US); Louis E. Silay, Twain Harte, CA (US)

(73) Assignee: Boart Longyear Inc., North Bay (CA)

( * ) Notice: Subject to any disclaimer, the term of this patent is extended or adjusted under 35 U.S.C. 154(b) by 128 days.

(21) Appl. No.: 11/088,003

(22) Filed: Mar. 23, 2005

(65) Prior Publication Data

US 2006/0214041 A1 Sep. 28, 2006

(51) Int. Cl.
*B28D 1/26* (2006.01)

(52) U.S. Cl. ..... 299/14; 299/37.3

(58) Field of Classification Search ..... 74/61; 299/100, 37.1, 37.3, 14
See application file for complete search history.

(56) References Cited

U.S. PATENT DOCUMENTS 1,964,746 A * 7/1934 Sloan ..... 299/37.3
2,627,849 A * 2/1953 Carlson ..... 123/197.1
2,960,314 A 11/1960 Bodine, Jr.
2,970,487 A 2/1961 Ongaro
2,975,846 A 3/1961 Bodine, Jr.
3,008,776 A 11/1961 Love et al.
3,030,715 A 4/1962 Bodine
3,151,912 A 10/1964 Herrmann
3,217,551 A 11/1965 Bodine, Jr.
3,224,514 A * 12/1965 Hornstein et al. ..... 175/55
3,268,749 A * 8/1966 Matsno ..... 310/81
3,278,235 A * 10/1966 Bergstrom ..... 299/37.2
3,419,313 A * 12/1968 Ulusal ..... 299/34.06
3,468,384 A 9/1969 Bodine
3,868,145 A 2/1975 Cobb et al.
3,922,017 A * 11/1975 Cobb ..... 299/70
4,227,744 A 10/1980 Livesay
4,247,149 A 1/1981 Livesay
4,265,129 A * 5/1981 Bodine ..... 74/61
4,318,446 A 3/1982 Livesay
4,515,408 A * 5/1985 Gurries ..... 299/37.2
4,603,748 A 8/1986 Rossfelder et al.
4,615,400 A 10/1986 Bodine
4,616,716 A * 10/1986 Bouplon ..... 173/49
4,736,987 A 4/1988 Lenzen et al.
5,027,908 A 7/1991 Roussy (Continued)

FOREIGN PATENT DOCUMENTS

DE 19921701 A1 2/2000

(Continued)

*Primary Examiner*—John Kreck
(74) *Attorney, Agent, or Firm*—Workman Nydegger

(57) ABSTRACT

A vibratory milling machine has a vibratory housing confined to substantially linear reciprocating motion relative to a base, causing a tool carried by the housing to impact a mineral formation or other workpiece substantially in a primary milling direction. The vibratory motion may be generated by two or more eccentrically-weighted rotors rotated by a common drive mechanism. The rotors may be arranged in pairs with the rotors of each pair rotating in opposite directions about parallel axes so that lateral oscillations cancel and longitudinal vibrations in the milling direction reinforce one another. In one embodiment, a hydrostatic fluid bearing is provided between the outer surface of each rotor and the housing.

26 Claims, 8 Drawing Sheets

U.S. PATENT DOCUMENTS

| | | | | |
|---|---|---|---|---|
| 5,086,854 | A | 2/1992 | Roussy | |
| 5,103,705 | A | 4/1992 | Bechem | |
| 5,190,353 | A | 3/1993 | Bechem | |
| 5,355,964 | A | 10/1994 | White | |
| 5,409,070 | A | 4/1995 | Roussy | |
| 5,562,169 | A | 10/1996 | Barrow | |
| 6,033,031 | A * | 3/2000 | Campbell | 299/39.1 |
| 6,139,477 | A | 10/2000 | Bechem et al. | |
| 6,561,590 | B2 | 5/2003 | Sugden | |

FOREIGN PATENT DOCUMENTS

| | | |
|---|---|---|
| WO | WO 00/43637 | 7/2000 |
| WO | WO 00/46486 | 8/2000 |

* cited by examiner

VIBRATORY MILLING MACHINE HAVING LINEAR RECIPROCATING MOTION

FIELD OF THE INVENTION

This invention relates to milling equipment, and more particularly to a vibratory milling machine for removing rock or cementitious material in a substantially linear reciprocating motion.

BACKGROUND OF THE INVENTION

In the milling of rock and cementitious materials, it is often required to remove large amounts of material, including hard mineral deposits, fairly rapidly. Machines have been proposed for this purpose in order to increase productivity and reduce labor costs over manual methods. Many such proposed tools have used oscillation in combination with other motions, such as in a rotating mining tool, to cut rock with less energy than otherwise would be required. Attempts to produce a machine using these concepts have met with limited success, however, due to the destructive nature of oscillation forces.

Another situation in which oscillation has been used to enhance the machining of rock is in drilling operations, such as core drilling through rock formations. Devices proposed for this purpose have used a pair of counter-rotating, eccentrically-weighted cylinders to create vibrational forces in the direction of a drill string. Such mechanisms remain free to move in directions other than the direction of the drill string, however, and therefore result in destructive oscillations, as well. Thus, it is desirable to provide a vibratory milling machine capable of rapidly removing rock or cemetitious material and yet having a long useful life.

SUMMARY OF THE INVENTION

The present invention confines a vibratory housing to substantially linear reciprocating movement relative to a base, causing a tool carried by the housing to impact a mineral formation or other work piece substantially in a primary milling direction. The vibratory motion is generated by two or more eccentrically-weighted rotors rotated by a common drive mechanism. The rotors are preferably arranged in pairs with the rotors of each pair rotating in opposite directions about parallel axes so that lateral oscillations cancel and longitudinal vibrations in the milling direction are maximized. When the rotors of this mechanism are rotated at a rate of 3000-6000 revolutions per minute (rpm), a milling tool carried by the housing is subjected to linear sonic vibrations in the range of 50-100 hertz. This facilitates the removal of material by the milling tool on a continuous basis.

The size of the milling machine is kept to a minimum by providing hydrostatic fluid bearings between the outer surfaces of the rotors and the housing itself. In one embodiment, the lubricant for these bearings is conducted through the housing and associated bearing inserts to the surface of the rotor.

Thus, the vibratory milling machine and method of the invention include: a base; a housing supported by the base for substantially linear reciprocating movement relative thereto in a milling direction; at least two rotors mounted for rotation relative to the housing substantially about respective primary axes, each of the rotors having an asymmetrical weight distribution about its primary axis for imparting vibratory forces to the housing as the rotor rotates; a drive structure for rotationally driving the rotors; and a milling tool carried by the housing for reciprocating movement against a workpiece substantially in the milling direction. In one embodiment, the milling machine has at least one pair of rotors positioned side-by-side in the housing with their primary axes on opposite sides of a central plane. The rotors of each pair are then synchronized with one another and rotate in opposite directions, and in phase, about their primary axes. In another embodiment, the rotor has a cylindrical outer surface and a pressurized fluid bearing is disposed between the rotor and the housing within which it rotates.

These and other aspects of the invention will be more readily comprehended in view of the discussion herein and the accompanying drawings wherein similar reference characters refer to similar elements.

DETAILED DESCRIPTION OF THE ILLUSTRATED EMBODIMENTS

Figure 1:
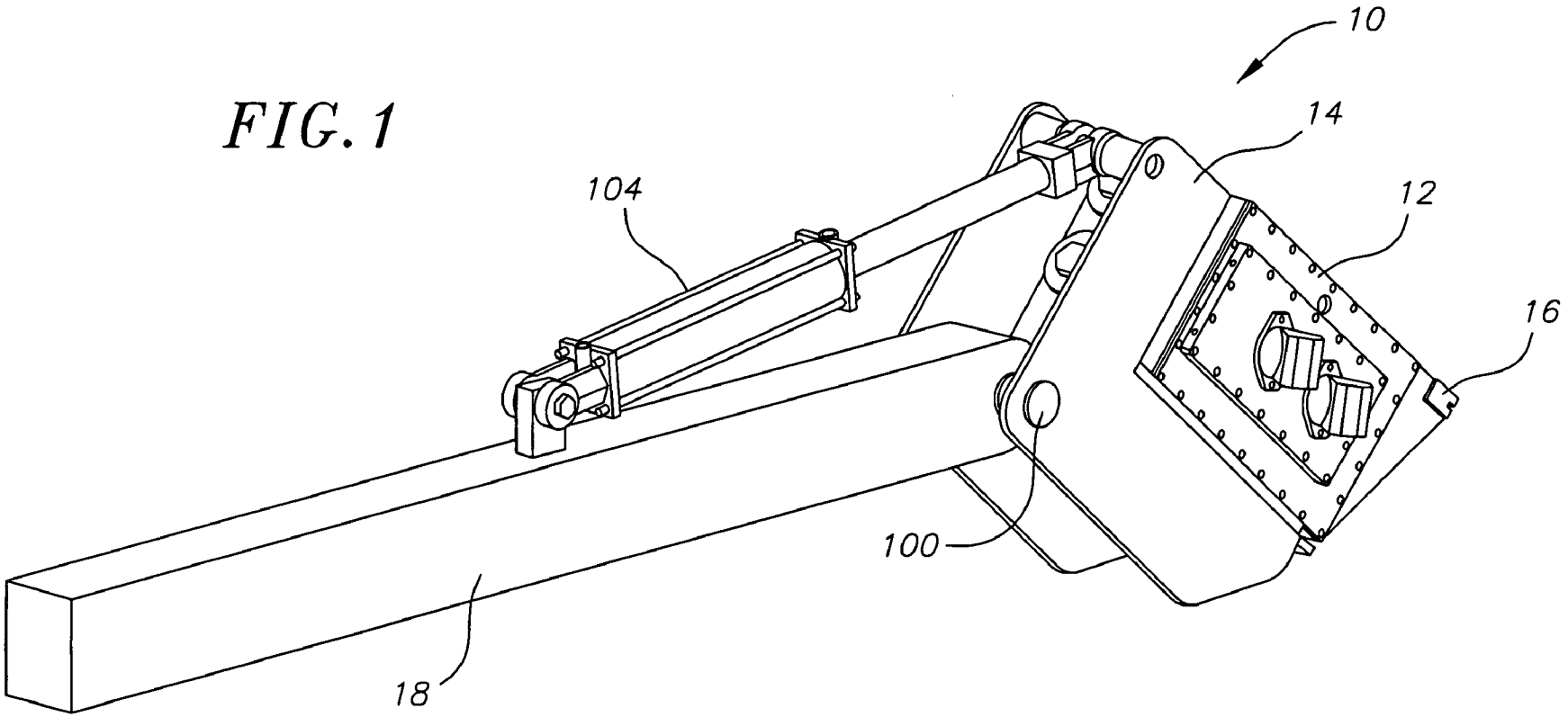
FIG. 1 is an isometric view of a vibratory milling machine constructed in accordance with an embodiment of the invention, the milling machine being mounted to a support arm of a conventional back hoe or other piece of excavating equipment.
Figure 2:
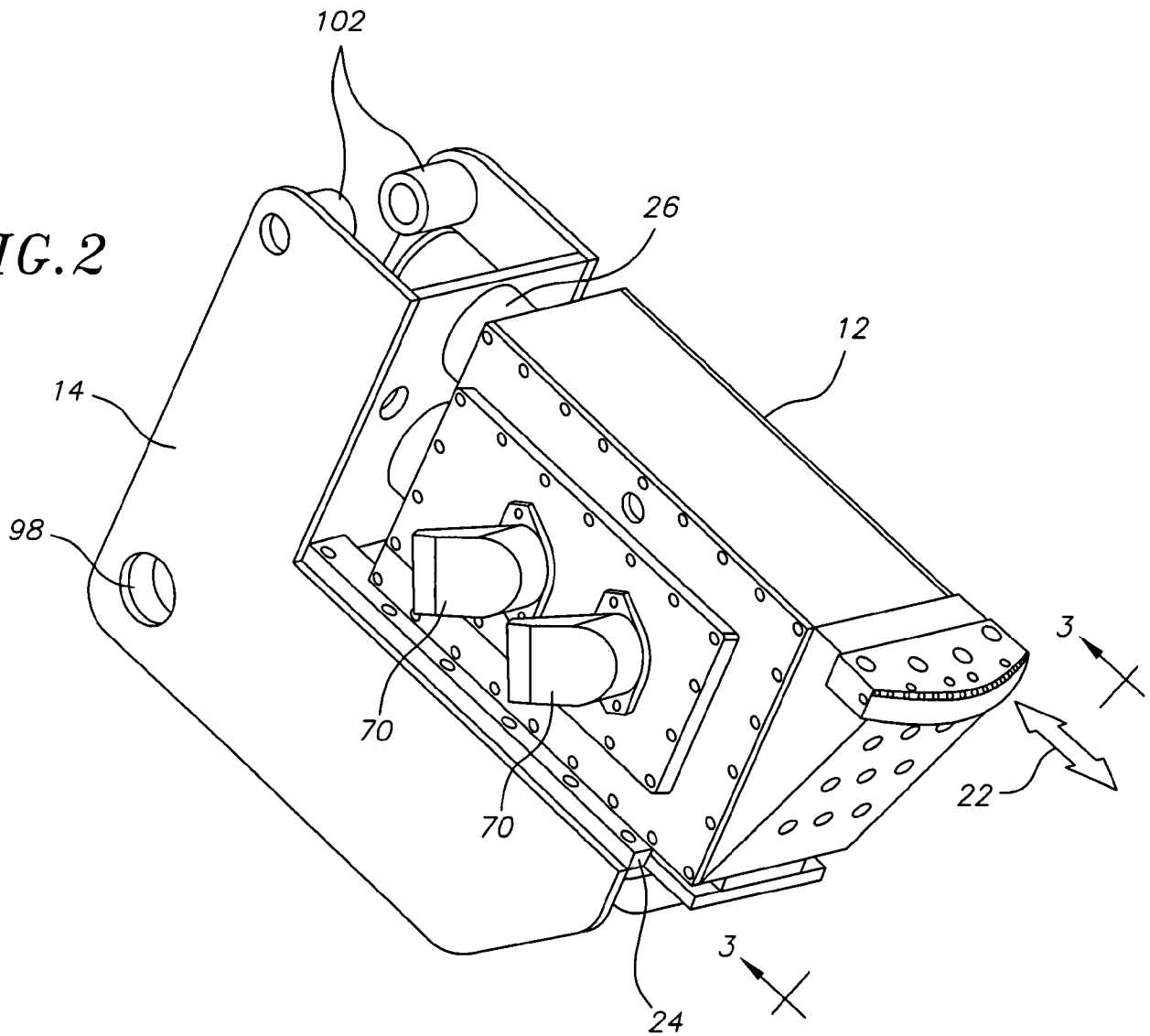
FIG. 2 is an isometric view of the vibratory milling machine of FIG. 1 removed from the support arm.
Figure 3:
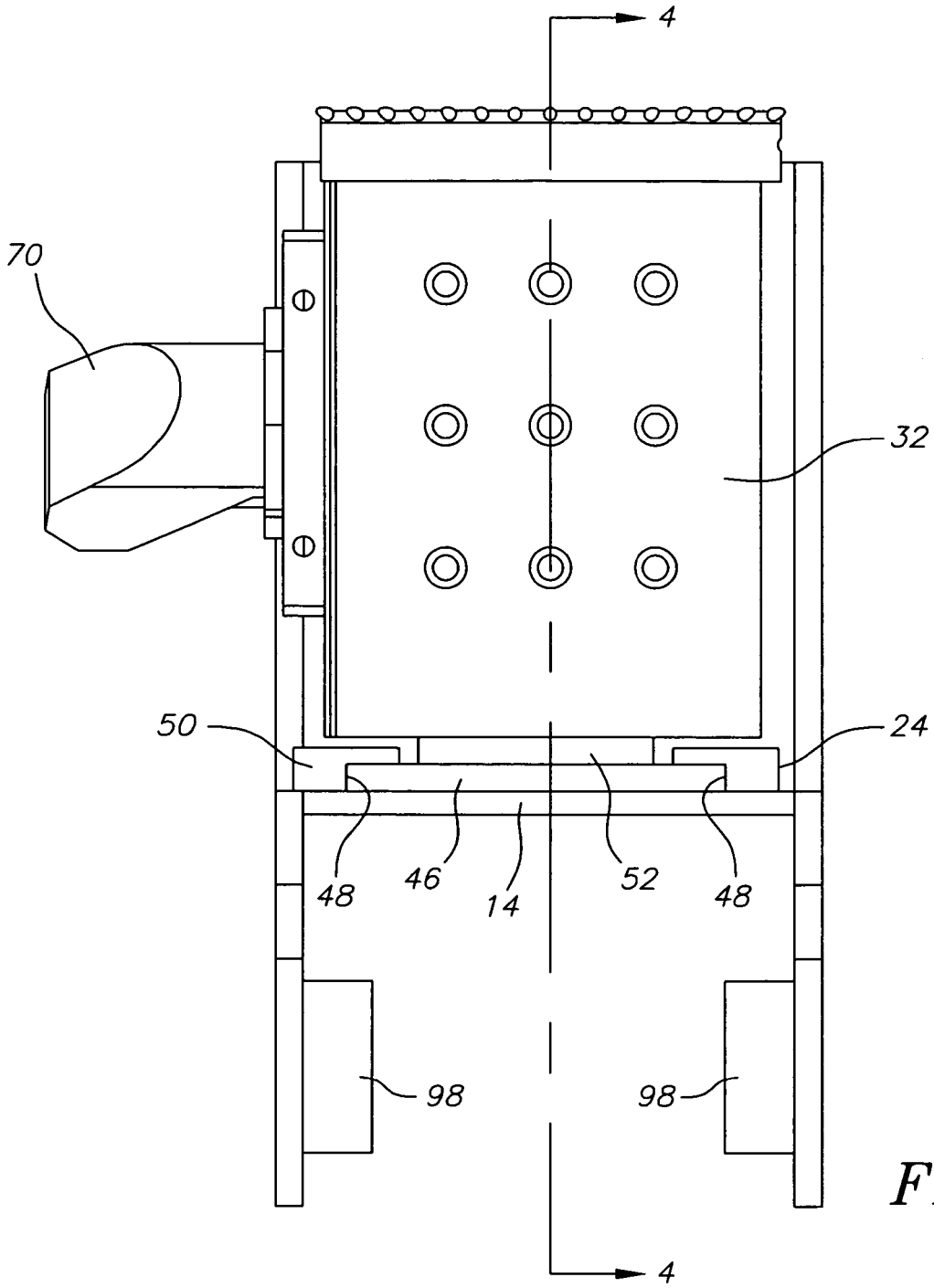
FIG. 3 is a bottom plan view of the vibratory milling machine of FIG. 2.
Figure 4:
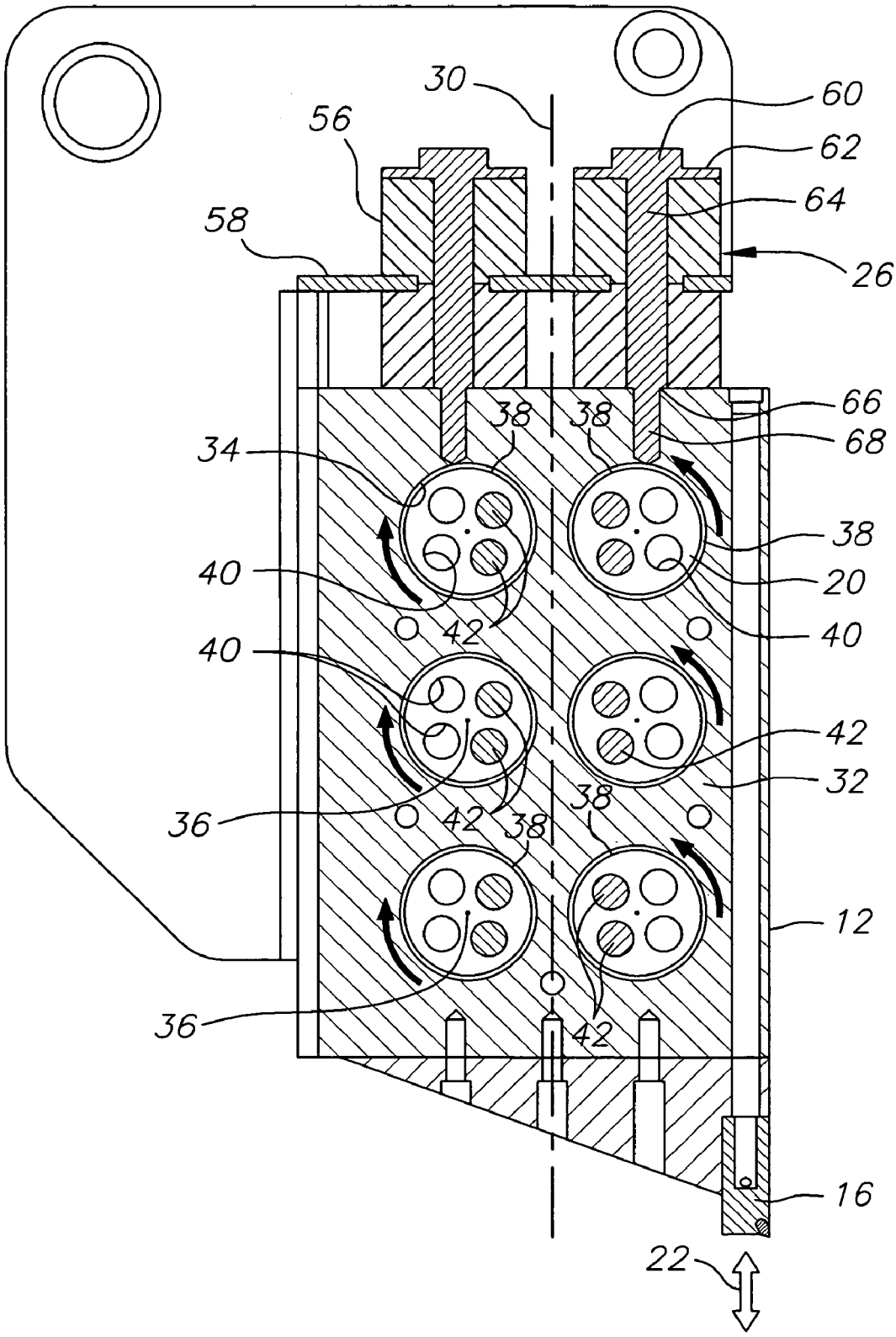
FIG. 4 is a cross-sectional view taken along the line 4-4 of FIG. 3.

Referring now to the drawings, and particularly to FIGS. 1-4, a vibratory milling machine 10 constructed according to an embodiment of the invention has a milling head 12 that oscillates in a substantially linear reciprocating fashion relative to a base 14 to drive a milling tool 16 against a rock formation, mineral deposit or other hard workpiece (not shown). The vibratory milling machine 10, and thus the milling tool 16, are moved against the workpiece by a support arm 18 of a conventional back hoe, hydraulic excavator or other piece of excavating equipment that carries the milling machine. As shown in FIG. 4, the milling head 12 is subjected to vibratory forces by rotors 20 arranged in pairs to rotate synchronously in opposing directions so that lateral oscillations cancel and longitudinal oscillations in a milling direction 22 are reinforced. As illustrated in FIGS. 2 and 3, movement of the milling head 12 relative to the base 14 is physically limited to the milling direction 22 by a slide mechanism 24. In addition, a bumper system 26 is provided at the upper end of the milling head 12 to limit the milling head 12 to a relatively short pre-defined range of travel in the milling direction.

Figure 8:
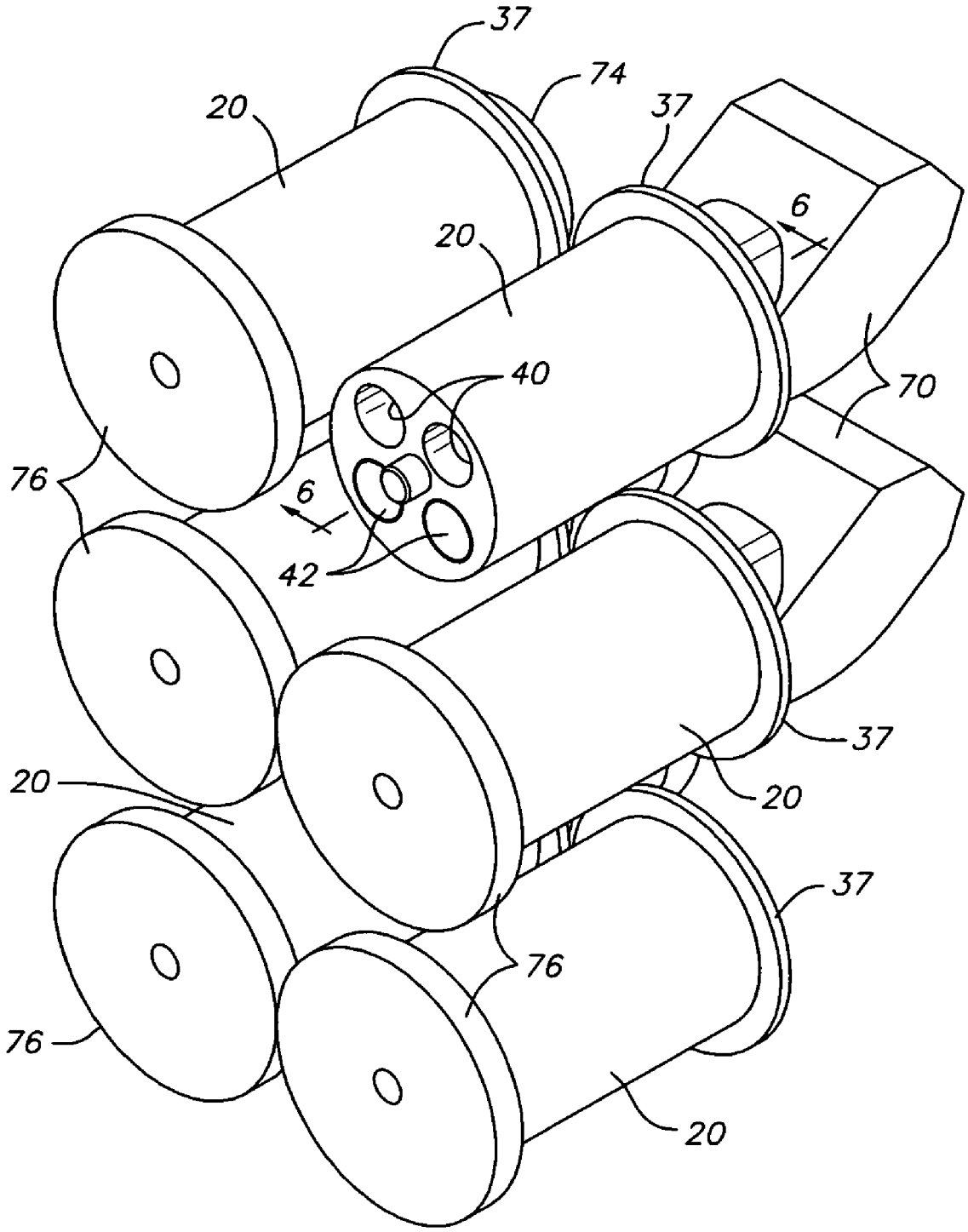
FIG. 8 is a somewhat stylized isometric view of the rotors, gear trains and motors of the milling head of FIGS. 1-7.

Referring now primarily to FIGS. 4 and 8, the milling head 12 in the illustrated embodiment has six rotors 20 arranged in three pairs which are disposed vertically relative to each other such that each pair of rotors has one rotor on either side of a central plane 30 extending vertically through the milling head 12. Each of the rotors 20 is mounted for rotation within a cylindrical recess 34 of a housing or "block" 32 about a corresponding primary axis 36. Each cylindrical recess 34 is lined with a pair of babbet-type bearing inserts 38 such that the outer cylindrical surface of the corresponding rotor 20 serves as a bearing journal. As described below, the bearings formed between the outer journal surfaces of the rotors 20 and the inner surfaces of the bearing inserts 38 are pressure-lubricated by oil or other suitable lubricant introduced radially inwardly through passages 39 (FIG. 9) within the housing 32 and between the bearing inserts 38, toward the outer journal surfaces of the rotors. The lubricant thus at least partially fills an annular space 41 between the outer journal surfaces of the rotors 20 and the inner surfaces of the bearing inserts 38, creating a hydro-dynamic journal bearing capable of withstanding the substantial vibrational forces created during operation of the milling machine 10. In addition, thrust washers 37 are provided at the ends of the rotors. These washers bear against outer ends of the bearing inserts which protrude (not shown) from the housing 32 to form thrust bearings for the rotors.

Vibrational forces are created by rotation of the rotors 20 due to the asymmetric weight distribution of each rotor about its primary axis 36. As illustrated in FIG. 4, each rotor has four length-wise openings 40 extending through it and arranged symmetrically about the axis 36 for reception of cylindrical weights 42. In the illustrated embodiment, two of the openings 40 of each rotor 20 are filled with cylindrical weights 42 and the other two openings are left empty. This causes each of the rotors 20 to be highly asymmetrical in mass, maximizing the vibrational force created by its rotation. The cylindrical weights 42 may be made of tungsten or other suitable material of high mass.

As illustrated in FIG. 4, rotors 20 of each pair rotate in opposite directions about their parallel axes and the weights 42 are positioned in their openings 40 such that the heaviest portions of the two rotors rotate "in phase", with each pair of rotors being synchronized such that all six of the rotors are in phase with each other. Thus, the lateral (i.e., perpendicular to the central plane 30) vibrational force created by one of the rotors 20 is precisely cancelled by an equal and opposite vibrational force created by the other rotor of the same pair. Lateral vibrations are neutralized in this way as the rotors 20 rotate synchronously within the housing 32, leaving only the longitudinal components of the vibrational forces to act on the main housing 32. This causes the vibrational forces of the milling head 12 to be channeled almost entirely into longitudinal forces coinciding with the milling direction 22, resulting in reciprocal movement of the milling head 12 relative to the base 14 by operation of the slide mechanism 24.

As shown in FIGS. 2 and 3, the slide mechanism 24 is made of a wear plate 46 that slides longitudinally along a pair of channels 48 formed by clamping bars 50 attached to the base 14. The wear plate 46 is attached to the housing 32 through a slide base 52. Thus, the slide mechanism 24 prevents undesirable lateral motion of the milling head 12 relative to the base 14 that might otherwise result from the high vibrational energy imparted to the milling head 12, and yet allows the milling head to move freely in the longitudinal, milling direction 22.

The details of the bumper system 26, that maintains the milling head 12 within a prescribed range of motion relative to the base 14, are illustrated most clearly in FIG. 4. In the illustrated embodiment, the bumper system 26 includes two pairs of bumpers 56 disposed on either side of a plate 58 of the base 14 such that respective bumper assembly bolts 60 extending downwardly through the bumpers and threaded into the main housing 32 serve to resiliently mount the main housing to the base. Each of the bumper assembly bolts has an integral washer-like flange 62 at its upper end and a shank portion 64 extending through the two washers and the plate 58 to a shoulder 66 and a reduced-diameter portion 68 which is threaded into the main housing 32. The bumper assembly bolts 60 are dimensioned to be threaded into the main housing 32 until they seat against the housing at the shoulders 66 to pre-compress the bumpers 56 by a preselected amount. Thus, the dimensions and make-up of the bumpers 56, as well as the dimensions of the bumper assembly bolt 60, can be modified to alter the spring constant and the extent of travel of the milling head 12 relative to the base 14.

Figure 6:
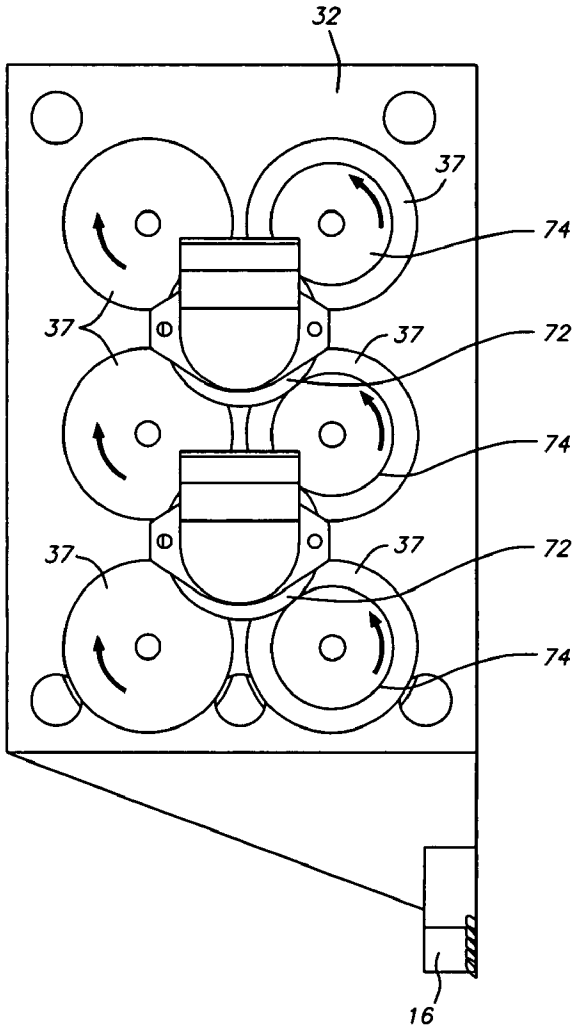
FIG. 6 is a left side elevational view of the milling head of FIG. 5 with the corresponding side cover removed to illustrate a gear train underneath.
Figure 5:
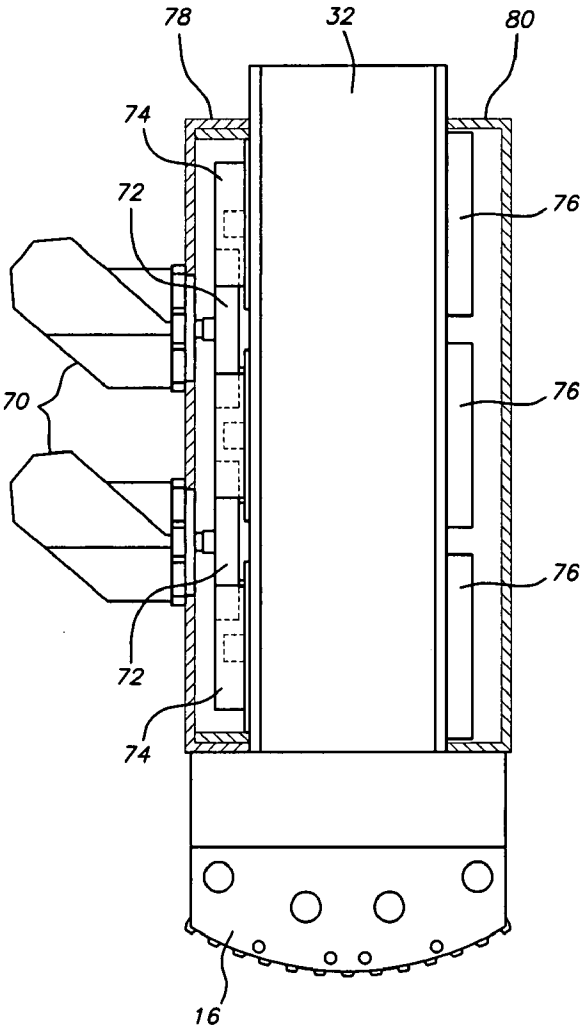
FIG. 5 is a front elevational view of a milling head of the vibratory milling machine of FIG. 2, shown separated from its base and with a pair of side covers of the milling head broken away to show the gear trains underneath.
Figure 7:
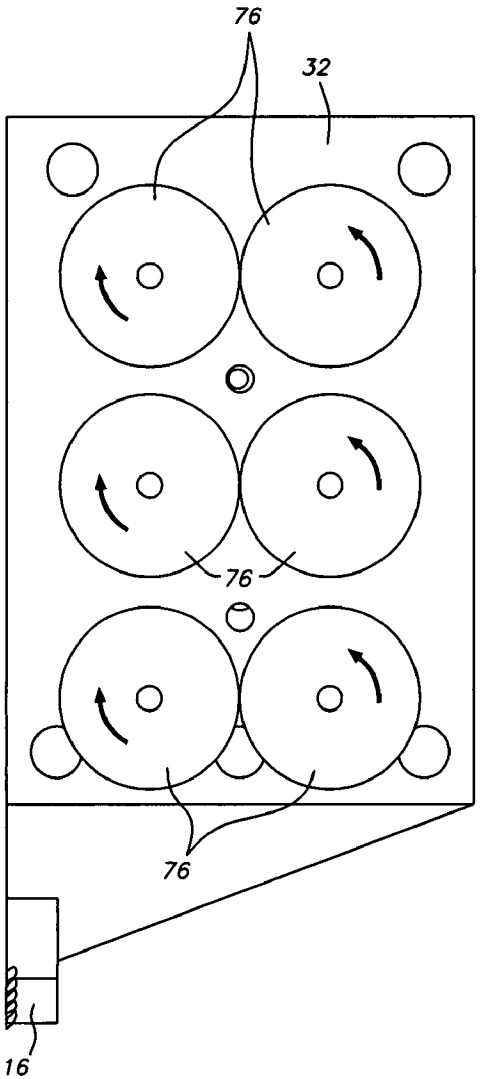
FIG. 7 is a right side elevational view of the milling head of FIG. 5 with the corresponding side cover removed to show the synchronizing gear train underneath.

The manner of synchronously driving the rotors 20 is seen most clearly in FIGS. 5-7, wherein a pair of motors 70 drive the three rotors on the right hand side of FIG. 6 through a pair of drive gears 72 on the output shafts of the motors which engage driven gears 74 carried by the rotors. Thus, for a clockwise rotation of the motors 70, as viewed in FIG. 6, the rotors on the right hand side of FIG. 6 will rotate in a counter-clockwise direction. As seen in FIG. 7, timing gears 76 are carried at the other ends of each of the rotors 20 such that the timing gears 76 of each pair of rotors engage each other. This causes the non-driven row of rotors (i.e., the row of rotors on the left hand side of FIG. 6) to rotate in a direction opposite to the first row of rotors which are driven directly by the motors 70. Thus, the operation of the gears 72 and 74 on the motor side of the milling head 12, along with the timing gears 76 on the back side of the milling head 12, serve to synchronize all six of the rotors 20 such that they all rotate at the same speed and in the same phase with the two vertical rows of rotors rotating in opposite directions.

As seen in FIG. 5, a side cover 78 covers the gear train on the motor side of the milling head, while a side cover 80 covers the timing gears 76 on the opposite side of the milling head. These two covers protect the gear trains and keep them clean while at the same time containing lubricant circulating within the milling head. In addition, a plurality of seals (not shown) may be provided on the motor side of each of the rotors to maintain lubricant pressure within the journal bearings. It will also be understood that additional bearings (not shown) may be provided at either end of the rotors 20 to facilitate their rotation relative to the main housing 32 when sufficient lubricant pressure is not available; however, the primary bearing function will nevertheless be served by the hydrodynamic journal bearings between the rotors and the main housing 32.

Figure 9:
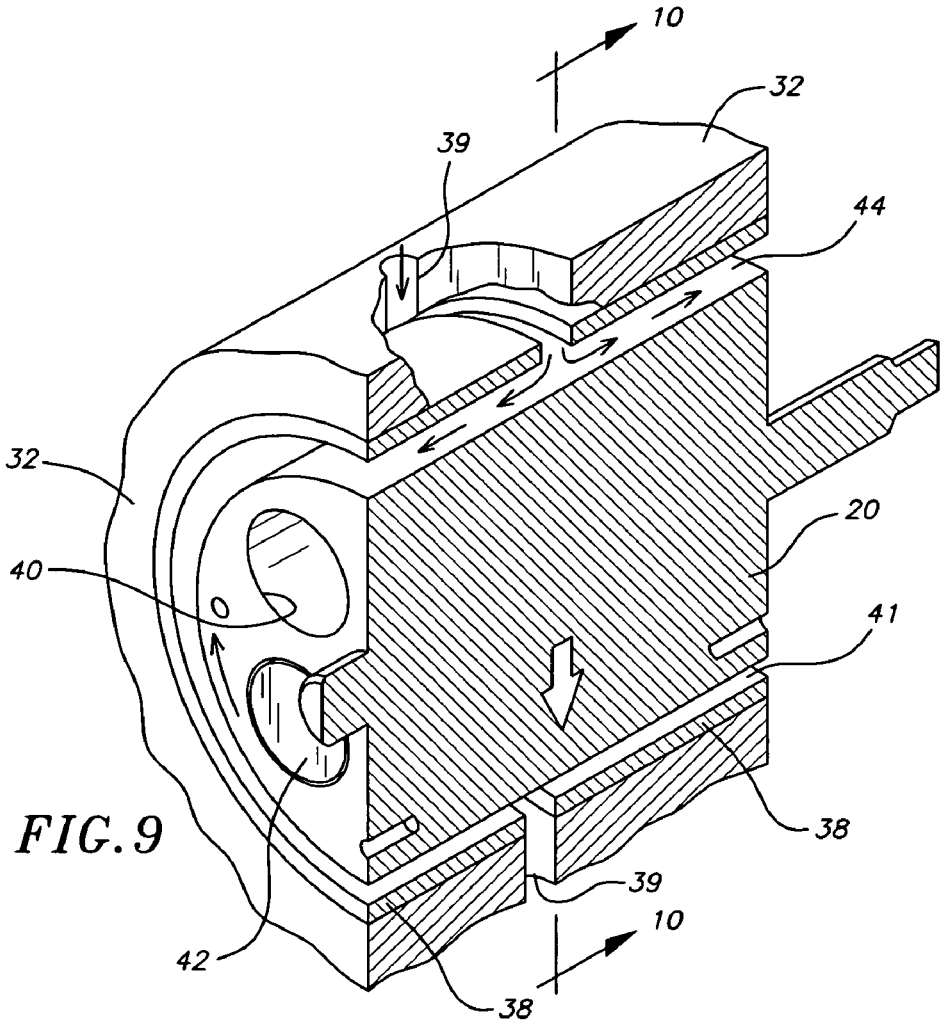
FIG. 9 is a somewhat diagrammatic vertical cross-sectional view of one of the rotors of FIG. 8 shown within a fragmentary portion of the housing, the clearances between the journal and the bearing being exaggerated to show the oil flow within the hydrodynamic journal bearing.
Figure 10:
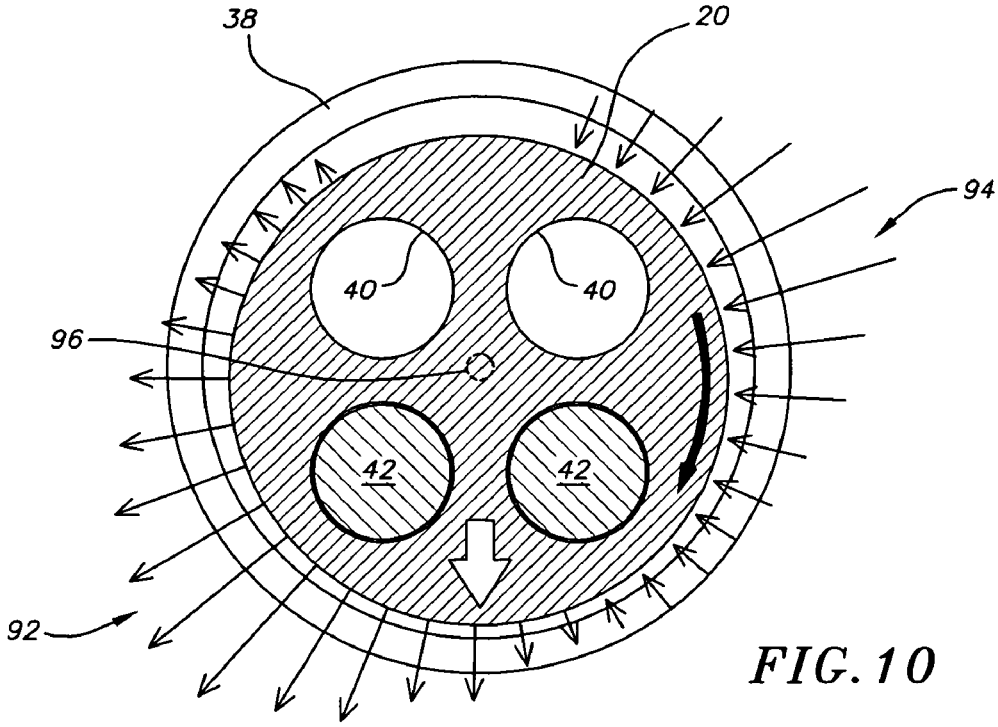
FIG. 10 is a somewhat diagrammatic view of the rotor of FIG. 9 showing in vector form the lubricant pressures within the bearing structure.
Figure 11A:
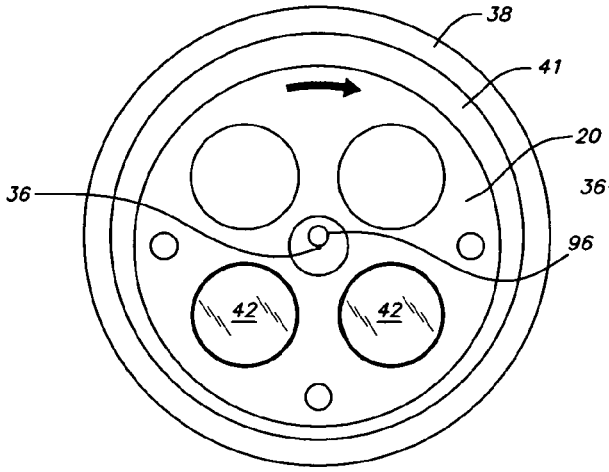
FIGS. 11A, 11B, 11C and 11D are sequential diagrammatic representations of the rotor of FIGS. 9 and 10 as it passes through one revolution of its rotational motion.
Figure 11B:
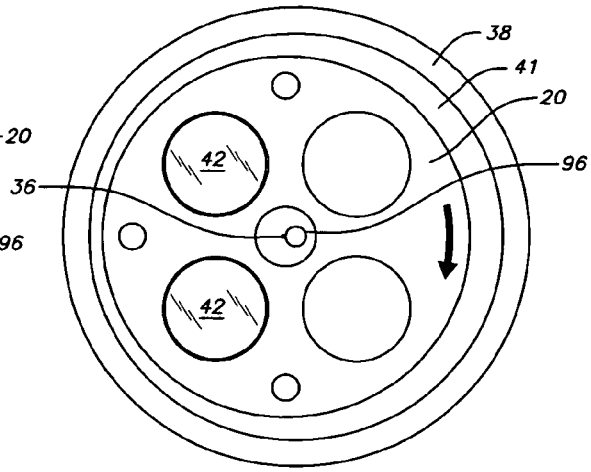
Figure 11C:
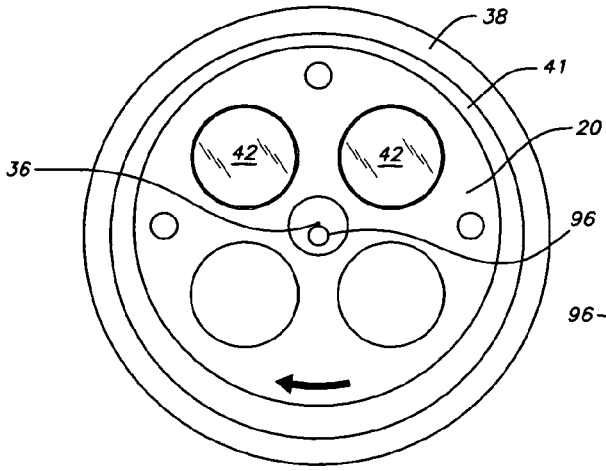
Figure 11D:
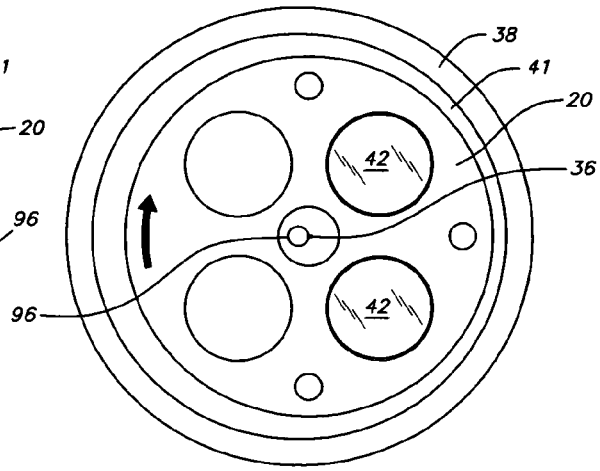

Turning now to FIGS. 9-11, the characteristics of the oil film between each of the rotors 20 and its corresponding bearing insert 38 are crucial to the operation of the hydrodynamic journal bearings and the useful life of the milling head 12. As shown in FIG. 9, in the illustrated embodiment, oil or other lubricant enters the cylindrical recess 34 of the housing 32 through the passages 39 and is conducted radially inwardly through a gap between the bearing inserts 38 to the space 41. The lubricant flows through the space 41 in a direction parallel to the rotors 20, and ultimately out through the thrust bearings at the ends of the rotors.

The pressure of the lubricant between the rotor and the bearing insert is illustrated schematically in FIG. 10 for a clockwise rotation of the rotor. The outwardly directed arrows of the pressure distribution 92 indicate a high positive pressure of the lubricant, whereas the inwardly directed arrows of the pressure distribution 94 indicate low lubricant pressure. Thus, as the rotor rotates within the insert 38, lubricant "whirls" just ahead of the point of maximum centrifugal load, causing the interface between the rotor and the bearing insert to be well lubricated where the load is felt most acutely. This "whirl" is shown in FIGS. 11A, 11B, 11C and 11D, which together represent sequential points in a single rotation of the rotor.

In the course of rotation, the primary axis of the rotor moves about its original location, defining a small circle near the center line of the bearing insert. This path of the rotor's axis is illustrated at 96 in FIG. 10. In one embodiment, the diameter of this circle is on the order of 0.006 to 0.008 inches. Of course, all of the clearances between the journal surface of the rotor 20 and the internal surface of the bearing, as well as the path 96 followed by the geometric center of the rotor, are exaggerated in FIGS. 9-11 for clarity. In order to accommodate this motion of the rotors' geometric centers, the drive gears 72, the driven gears 74, and the timing gears 76 are provided with adequate backlash to permit the eccentric motion without binding.

The structures of the support arm 18 and the base 14 are illustrated most clearly in FIGS. 1-3, wherein the base 14 is illustrated as a heavy weldment made of high-strength steel able to withstand the extremely high forces created in automated milling operations. As illustrated in FIGS. 2 and 3, the base 14 is provided with a pair of bosses 98 for receiving a pivot pin or bolt 100 to pivotally attach the base 14 and support arm 18 of a back hoe or other piece of excavating equipment (not shown) with which the milling machine 10 is used. The base 14 is also provided with a pair of bosses 102 at a point displaced from the pivot pin 100 for actuation by an hydraulic ram 104 that itself is anchored to the support arm 18. Thus, as the support arm is moved, the vibratory milling machine 10 can be moved to any desired location so that the milling tool 16 contacts the rock or other workpiece being machined. When it is desired to change the orientation of the milling machine relative to the support arm, the hydraulic ram 104 can be actuated. This places the operator in complete control of the orientation and use of the milling machine 10.

The various elements of the milling machine 10 may be made of a wide variety of materials without deviating from the scope of the invention. In one embodiment, the base 14, the milling head 12, the rotors 20 and the clamping bars 15 are made of high-strength steel, while the wear plate 46 of the slide mechanism 24 would be of a softer, dissimilar material such as a bronze alloy, nylon or a suitable fluorocarbon polymer of the type marketed by Dupont under the trademark, Teflon. The babbet-type bearing inserts 38 may also be made of a variety of materials, however in one embodiment they are steel-backed bronze bearing inserts of the type used in the automotive industry. One such bearing insert is a steel-backed bushing marketed by Garlock under the designation DP4 080DP056. These particular bushings have an inside diameter that varies between 5.0056 and 4.9998 inches. In this embodiment, due to the wide tolerance range, the rotors may be finished to the actual size required after the bushings are installed in the housing. The finish on the resulting outer cylindrical surface of the rotors 20 may also be given a texture, such as that of a honed cylindrical bore, to maximize bushing life and oil film thickness. The cylindrical weights 42 within the rotors 20 may be tungsten carbide or other suitable material having suitable weight and corrosion-resistance properties.

In another embodiment, the clearance between the rotor's outer surface and the inner surface of the bearing inserts is between 0.008 and 0.010 inches. The minimum calculated lubricant film thickness at 4500 revolutions per minute is then between 0.00179 and 0.00194 inches. Oil flow through each bearing may be 2.872 to 3.624 gallons per minute, for a total of 34.5 to 43.5 gallons per minute for the entire machine. Power loss per bearing at 4500 revolutions per minute is calculated as 9.579 to 9.792 horsepower or 115 to 118 horsepower total. Temperature rise through the bearings is then between 32 and 41 degrees Fahrenheit, for a total heat load of 4900 to 5000 BTU/minute from the bearings. Oil scavenge is through a 2.00 inch port (not shown) in one of the housing side covers 78 or 80.

In still another embodiment, the hydraulic motors 70 and the various gear sets may be selected to cause the rotors to spin in a range of between 3000 and 6000 revolutions per minute. This corresponds to a frequency of movement of the milling head 12 between 50 and 100 hertz. Thus, in such an embodiment, the milling tool 16 would be actuated at sonic frequencies against rock or other mineral deposits to machine material away in a milling operation.

Although certain exemplary embodiments of the invention have been described above in detail and shown in the accompanying drawings, it is to be understood that such embodiments are merely illustrative of, and not restrictive of, the broad invention. It will thus be recognized that various modifications may be made to the illustrated and other embodiments of the invention described above, without departing from the broad inventive concept. In view of the above it will be understood that the invention is not limited to the particular embodiments or arrangements disclosed but is rather intended to cover any changes, adaptations or modifications which are within the scope and spirit of the invention as defined by the appended claims. For example, the hydrodynamic journal bearings of the invention can be replaced by mechanical bearings such as packed or permanently lubricated ball or roller bearings, if desired. Likewise, the frequency of operation and the physical arrangement of the rotors can be altered depending on the application being addressed.

What is claimed is:

1. A vibratory milling machine comprising:

a base comprising a recess in a distal end of the base and one or more bosses positioned at a proximal end of the base, the one or more bosses being adapted to secure the base to a support arm;

a housing having at least a first end and a second end, the housing being secured at the first end within the recess of the base, the housing adapted for substantially linear reciprocating movement relative to the base in a milling direction;

at least two rotors mounted within the housing and adapted for rotation relative to the housing substantially about respective primary axes, each of the rotors having a asymmetrical weight distribution about its primary axis for imparting vibratory forces to the housing as the rotor rotates;

a drive structure for rotationally driving the rotors; and a milling tool secured to the second end of the housing, the milling tool being adapted for reciprocating movement against a workpiece substantially in the milling direction.

2. The vibratory milling machine of claim 1, wherein the housing is resiliently mounted to the base at least in part by a block of resilient material secured between the housing and the base.

3. The vibratory milling machine of claim 2 wherein:

the housing is mounted to the base by at least an additional block of resilient material.

4. The vibratory milling machine of claim 1 having:

at least one pair of said rotors positioned side-by-side in the housing with their primary axes on opposite sides of a central plane.

5. The vibratory milling machine of claim 4 wherein:

the rotors of each pair are synchronized with one another and rotate in phase and in opposite directions about their primary axes.

6. The vibratory milling machine of claim 1 having:

a plurality of said pairs of rotors positioned with the primary axes of each pair disposed on opposite sides of a central plane.

7. The vibratory milling machine of claim 6 wherein: the drive structure comprises at least one motor.

8. The vibratory milling machine of claim 7 wherein: said at least one motor is hydraulic.

9. The vibratory milling machine of claim 7 wherein:

each pair of rotors includes a first rotor driven by the motor and a second rotor synchronized to the first rotor for rotation in an opposite direction.

10. The vibratory milling machine of claim 1 wherein:

each of the rotors has a cylindrical outer surface; and pressurized fluid bearings are disposed between each of the rotors and the housing.

11. The vibratory milling machine of claim 10 wherein:

each of the pressurized fluid bearings comprises at least one passage for delivering pressurized lubricant to a space between the corresponding rotor and the housing.

12. The vibratory milling machine of claim 11 wherein:

each of the rotors has a cylindrical outer surface; and said passages are within the housing and extend toward the cylindrical outer surfaces of the rotors.

13. The vibratory milling machine of claim 11 wherein the pressurized fluid bearings comprise:

bearing inserts within the housing and surrounding the rotors; and at least one passage within the housing for delivering pressurized lubricant to a space between each rotor and the corresponding insert.

14. In a vibratory milling machine having a milling tool carried on a vibratory housing, the method of milling comprising:

moving the milling tool in a substantially linear reciprocating manner by rotating at least two eccentrically weighted rotors within the housing to create vibratory forces, wherein the housing is resiliently secured to a supporting base;

confining the housing to move in a substantially linear direction along a pair of channels of the supporting base; and milling a material by controlling the supporting base so that the milling tool contacts the material.

15. The method of milling rock as recited in claim 14 wherein:

rotating at least two eccentrically weighted rotors comprises counter-rotating at least one pair of rotors disposed on opposite sides of a central plane containing a milling direction.

16. A vibratory milling machine comprising:

a base comprising a recess and a pair of channels;

a housing secured within the recess of the base by a plate, the plate being adapted to slide longitudinally within the pair of channels to enable substantially linear reciprocating movement of the housing relative to the base in a milling direction;

at least two rotors mounted within the housing for rotation relative to the housing substantially about respective primary axes, each of the rotors having a cylindrical outer surface for reception within a corresponding cavity formed by interior walls of the housing, each of the rotors also having an asymmetrical weight distribution about its primary axis;

a pressurized fluid bearing structure between the outer surfaces of the rotors and the interior walls of the housing;

a drive structure for rotationally driving the rotors; and a milling tool carried on the housing for reciprocating movement against a workpiece in substantially the milling direction.

17. The vibratory milling machine of claim 16 wherein:

the pressurized fluid bearing structure comprises at least one passage within the housing for delivering pressurized lubricant to a space between each rotor and the housing.

18. The vibratory milling machine of claim 17 wherein:

said at least one passage is within the housing and extends toward the outer surfaces of the rotors.

19. The vibratory milling machine of claim 18 wherein the pressurized fluid bearing structure comprises:

bearing inserts lining the cavities of the housing and surrounding the rotors; and at least one passage within the housing for delivering pressurized lubricant to a space between each rotor and the corresponding insert.

20. A milling system containing a vibratory milling machine comprising:

a base adapted to be secured to a distal end of a support arm;

a housing resiliently mounted within a recess of the base by a bumper system adapted to restrict movement of the housing relative to the base, the bumper system including at least one bumper secured between the base and the housing and an assembly bolt extending through the bumper and into the housing, wherein the housing includes a plate adapted to move within at least one channel of the base to restrict movement of the housing in a substantially linear direction relative to the base;

at least two rotors mounted within the housing, the at least two rotors adapted to rotate relative to the housing substantially about respective axes, each of the rotors having an asymmetrical weight distribution about its axis, wherein the rotors are adapted to impart a vibratory force to the housing as each of the rotors rotates; and a milling tool carried on the housing and adapted for reciprocating movement against a workpiece substantially in the milling direction.

21. A vibratory milling machine comprising:

a base;

a housing adapted for substantially linear reciprocating movement relative to the base in a milling direction, the housing being resiliently secured within a recess of the base by a bumper system, the bumper system including at least one block of resilient material secured between the base and the housing and an assembly bolt extending through the block into the housing;

at least two rotors mounted for rotation relative to the housing substantially about respective primary axes, each of the rotors having a asymmetrical weight distribution about its primary axis for imparting vibratory forces to the housing as the rotor rotates;

a drive structure for rotationally driving the rotors; and a milling tool carried on the housing for reciprocating movement against a workpiece substantially in the milling direction.

22. The vibratory milling machine of claim 21, wherein the base comprises a pair of channels adapted to restrict movement of the housing in the milling direction.

23. The vibratory milling machine of claim 21, wherein the base comprises a pair of channels formed at least in part by at least one clamping bar attached to the base.

24. The vibratory milling machine of claim 23, wherein the housing comprises a plate, the plate being adapted to move in the pair of channels to restrict movement of the housing in the milling direction.

25. The vibratory milling machine of claim 1, wherein the base comprises a pair of channels adapted to restrict movement of the housing in the milling direction.

26. The vibratory milling machine of claim 25, wherein the housing comprises a plate, the plate being adapted to move in the pair of channels to restrict movement of the housing in the milling direction.

* * * * *